US006186617B1

(12) United States Patent
Ahn

(10) Patent No.: US 6,186,617 B1
(45) Date of Patent: Feb. 13, 2001

(54) DEVICE FOR STORING AND SUPPLYING ACTIVE LIQUID IN INK JET PRINTHEAD

(75) Inventor: Byung-Sun Ahn, Suwon-si (KR)

(73) Assignee: Samsung Electronics Co., Ltd., Suwon (KR)

( * ) Notice: Under 35 U.S.C. 154(b), the term of this patent shall be extended for 0 days.

(21) Appl. No.: 09/063,061

(22) Filed: Apr. 21, 1998

(30) Foreign Application Priority Data

Apr. 21, 1998 (KR) ..... 97-14828

(51) Int. Cl.[7] ..... B41J 2/05
(52) U.S. Cl. ..... 347/67; 347/54
(58) Field of Search ..... 347/54, 63, 65, 347/67, 75, 85, 86, 87, 89, 95

(56) References Cited

U.S. PATENT DOCUMENTS

| | | | | |
|---|---|---|---|---|
| 4,364,059 | | 12/1982 | Nagayama | 347/89 |
| 4,480,259 | * | 10/1984 | Kruger et al. | 347/54 |
| 4,580,148 | | 4/1986 | Domoto et al. | 347/63 |
| 4,788,556 | | 11/1988 | Hoisington et al. | 347/92 |
| 4,907,020 | * | 3/1990 | Shiozaki | 347/67 |
| 5,017,941 | | 5/1991 | Drake | 347/67 |
| 5,084,713 | | 1/1992 | Wong | 347/18 |
| 5,119,115 | | 6/1992 | Buat et al. | 347/86 |
| 5,231,424 | | 7/1993 | Kaneko et al. | 347/29 |
| 5,265,315 | | 11/1993 | Hoshington et al. | 29/25.35 |
| 5,659,346 | | 8/1997 | Moynihan et al. | 347/68 |
| 6,074,043 | * | 6/2000 | Ahn | 347/54 |

* cited by examiner

*Primary Examiner*—N. Le
*Assistant Examiner*—Anh T. N. Vo
(74) *Attorney, Agent, or Firm*—Robert E. Bushnell, Esq.

(57) ABSTRACT

A device for storing and supplying an active liquid in an ink jet printhead including: an ink injector for jetting ink stored in an ink storage tank; and an active liquid storage tank mounted in close contact with one side of the bottom of the ink storage tank, storing an active liquid to be supplied to the ink injector, the ink injector having a single fluid path formed therein so as for the active liquid to be circulated and returned to the active liquid storage tank, the device having such a fluid path as to supply the active liquid between the heating chambers in the ink injector, cooling the heating chambers rapidly with the high speed of printing, and making it possible to check the completion of injection of the active liquid through feeding and circulating apertures.

20 Claims, 9 Drawing Sheets

DEVICE FOR STORING AND SUPPLYING ACTIVE LIQUID IN INK JET PRINTHEAD

CLAIM OF PRIORITY

This application makes reference to, incorporates the same herein, and claims all benefits accruing under 35 U.S.C. §119 from an application for DEVICE FOR STORING AND SUPPLYING ACTIVE LIQUID IN INK JET PRINTHEAD earlier filed in the Korean Industrial Property Office on the Apr. 21, 1998 and there duly assigned Ser. No. 14828/1997.

BACKGROUND OF THE INVENTION

1. Field of the Invention

The present invention generally relates to a device for storing and supplying an active liquid in an ink jet printhead and, more particularly, to a device for storing and supplying an active liquid in an ink jet printhead wherein a heating chamber is heated to change the shape of the membrane that separates an ink chamber storing the active liquid from the heating chamber and thereby the ink disposed in an ink chamber is jetted onto a print media.

2. Discussion of Related Art

Generally, an ink jet printer has a control section which is receptive to print data generated from a system. The control section processes the print data, generating a control signal for driving an ink jet printhead to jet ink stored therein through a nozzle in order to produce an image onto the media in response to the print data.

An exemplary ink jet printhead stores and jets ink in drops in response to the control signal applied from the control section. The exemplary ink jet printhead is includes: an elastic body for storing ink; a housing having the ink-storing elastic body built therein, and forming an ink filter which filters the ink and is glued to the bottom surface of the ink-storing elastic body, an ink stand pipe which forms a feeding path of the ink filtered through the ink filter, and an ink via; an ink injector for injecting the ink supplied through the ink via of the housing in drops in response to an electrical signal applied to an electrical connection; and a housing cover for covering the housing tightly by heat or ultrasonic fusion after the ink-storing elastic body is mounted in the housing, and making an orifice to maintain the atmospheric pressure constant.

The ink enjector of the exemplary inkjet printhead includes: a substrate providing a support; a metal layer deposited on the substrate; a heater deposited on the metal layer in a specified pattern to convert electrical energy to heat; two electrodes deposited in contact with the heater in order to supply electrical energy to the heater; a heating chamber barrier deposited on the upper surface of the two electrodes so as to form a heating chamber; plural membranes glued to the upper surface of the heating chamber barrier and heated by the heater to be expanded and changed in shape; an ink chamber barrier glued to the upper surface of the plural membranes so as to form an ink chamber; and a nozzle plate glued to form an orifice in accord to the ink chamber.

The ink jet printhead of such a configuration maintains the pressure in the housing at the atmospheric pressure through the orifice disposed at a specified position in the housing cover. Jetting ink through the ink injector while maintaining the pressure in the housing at the atmospheric pressure causes a suction, that is, a buoyant pressure generated from the jetting force.

The buoyant pressure produced in the ink enjector of the ink jet printhead forces the ink in an open shell formed in the ink-storing elastic body to be filtered through the ink filter and supplied to the ink enjector via the ink stand pipe and ink via.

The ink supplied to the ink enjector forms droplets and is jetted according to the electrical signal applied to the electrical connection. That is, electrical energy is applied to the heater through the two electrodes, wherein the heater is deposited in a specified pattern on the metal layer overlying the substrate which is to support the ink enjector.

The electrical energy applied to the heater heats the active liquid filled in the heating chamber to create the vapor pressure, which causes a plurality of membranes to be expanded.

In addition to the expansion of the plural membranes, the vapor pressure expands the ink which is supplied to the ink chamber defined by the ink via and the ink chamber barrier. As the expansion of ink interrupts the electrical energy supply to the two electrodes, the expanded ink forms droplets due to the surface tension and is jetted onto the print media.

Once the ink droplets are jetted through the ink enjector, external air is introduced through the orifice disposed at a specified position in the housing cover such that the top portion of the ink-storing elastic body is filled with air in an amount as much as the jetted ink. Under pressure as much as the amount of air that fills the top portion of the ink-storing elastic body, the ink moves down to the bottom of the elastic body.

The ink enjector jets the ink onto the print media to produce a font or graphic image according to the electrical signal applied from the electrical connection.

It is, however, difficult to check the complete enjection of the active liquid into the respective heating chambers disposed in the ink enjector of the ink jet printhead utilizing membranes. Also, the enjector is inapplicable to long time use in that the active liquid within the ink injector is heated to vaporization or consumption, resulting in deterioration of the injection rate of the ink with a consequence of dot omission. Furthermore, as the ink chamber is formed with the active ink jetted thereinto, the formation of the ink chamber is difficult in the exemplary art.

U.S. Pat. No. 4,364,059 to Nagayama, entitled Ink Jet Printing Apparatus, discloses an ink jet printing apparatus whereby ink is recirculated from a reservoir through an ink ejection head and back to the reservoir while it has been heated prior to actual printing to purge air from the ink and prevent erroneous ejection. U.S. Pat. No. 4,580,148 to Domoto et al., entitled Thermal Ink Jet Printer With Droplet Ejection By Bubble Collapse, discloses a thermal ink jet printer with droplet ejection by bubble collapse, whereby a thermal ink jet printhead ejects ink droplets on demand by utilizing the conservation of momentum of collapsing bubbles in a layer of liquid ink having a predetermined thickness. It is disclosed that the printhead has an ink containing chamber with an array of individually addressable heating elements on one chamber interior surface which are aligned with an elongated opening in a parallel, confronting chamber wall. U.S. Pat. No. 4,788,556 to Hoisington et al., entitled Deaeration Of Ink In An Ink Jet System, discloses a deaeration of ink in an ink jet system, whereby an elongated ink path leading to an ink jet head is formed between two permeable membranes. The membranes are disclosed as being backed by air plenums which contain support members to hold the membranes in position.

Reduced pressure is disclosed as being applied to the plenums to extract dissolved air from the ink in the ink path, and increased pressure can also be applied to the plenums to eject ink from the inkjet head for purging. It is disclosed that within the ink jet head ink is circulated convectively from the orifice to the deaerating path even when the jet is not jetting ink.

U.S. Pat. No. 5,084,713 to Wong, entitled Method And Apparatus For Cooling Thermal Ink Jet Print Heads discloses a method and apparatus for cooling thermal ink jet printheads. A thermal ink jet cartridge is disclosed which uses a resistor assembly to eject ink from the cartridge. To control heat generated by the resistors, a cooling system is disclosed as being provided that consists of an ink channel positioned adjacent the resistor substrate, with the channel being supplied with ink from a chamber within the cartridge. The ink flowing through the channel contacts the substrate, causing a cooling effect, the ink then being returned to the chamber in the cartridge. It is disclosed that the system may consist of a thin-film resistor positioned adjacent at least one of the openings provided between the channel and the chamber, and when the resistor is energized and heated, it is disclosed as causing ink to flow through the openings and back into the chamber. U.S. Pat. No. 5,017,941 to Drake, entitled Thermal Ink Jet Printhead With Recirculating Cooling System, discloses a thermal ink jet printhead with recirculating cooling system, whereby a thermal ink jet printer is disclosed as having a printhead with a passageway therein for the circulation of a cooling fluid therethrough, with the passageway being parallel and closely adjacent the array of bubble generating heating elements. The printhead is disclosed as being composed of mated silicon channel and heater plates, with the passageway being formed in an embodiment by forming a groove in the heater plate surface opposite the one containing the heating elements and addressing electrodes followed by the mating of a silicon sealing plate having inlet and outlet openings etched therein. Tubes for circulating a cooling fluid, such as ink, are disclosed and are sealingly attached to the inlet and outlet openings. In another embodiment, it is disclosed that the groove may be formed in the sealing plate or in both the sealing plate and the printhead heater plate. In a further embodiment, it is disclosed the passageway for the cooling fluid is provided by etching a channel in a thick film layer deposited on the heater plate surface opposite the one with the heating elements. It is disclosed that the circulated cooling fluid prevents printhead temperature fluctuations during the printing operation.

U.S. Pat. No. 5,265,315 to Hoisington et al., entitled Method Of Making A Thin-Film Transducer Ink Jet Head discloses a method of making a thin-film transducer ink jet head, by oxidizing one surface of a silicon wafer to provide a dielectric layer, forming electrodes on the layer by photoresist processing techniques, depositing one or more layers of PZT material to provide a thin-film piezoelectric layer, forming another pattern of electrodes on the surface of the PZT layer by photoresist techniques, and selectively etching the silicon substrate in the region of the electrodes to provide an ink chamber. Thereafter, an orifice plate is disclosed as being affixed to the substrate to enclose the ink chambers and provide an ink orifice for each of the chambers. U.S. Pat. No. 5,231,424 to Kaneko et al., entitled Ink Jet Recording Apparatus With Efficient Circulation Recovery, discloses ink jet recording apparatus with circulation recovery. The ink jet recording apparatus is disclosed as including a recording head for recording on the recording medium by discharging ink through discharge ports, an ink tank for storing the ink, a first ink flow channel for passing the ink from the ink tank to the recording head, a second ink flow channel for passing the ink from the recording head into the ink tank, a filter provided in the first ink flow channel, and a back flow prevention valve provided in the second ink flow channel.

U.S. Pat. No. 5,119,115 to Buat et al., entitled Thermal Ink Jet Print Head With Removable Ink Cartridge, discloses a thermal ink jet printhead with a removable ink cartridge, whereby in a thermal ink jet printhead the ink is expelled in the form of small drops through a plurality of nozzles communicating with corresponding expulsion chambers for expulsion of the ink through the effect of rapid heating of heater elements contained in the expulsion chambers. It is disclosed that the nozzles, the expulsion chambers, the heater elements and the associated electrical conductors are constructed in a plurality of metal layers and insulating layers supported by a silicon plate with the plate being fixed to the structure of the head and being supplied with ink contained in a movable cartridge fitted to the structure of the head. U.S. Pat. No. 5,659,346 to Moynihan et al., entitled Simplified Ink Jet Head, discloses a simplified ink jet head, whereby a carbon plate is disclosed as being formed with orifice passages extending through the plate, pressure chambers on one side of the plate, flow-through passages on the other side of the plate and ink supply passages, and a piezoelectric plate having a conductive coating on the exposed side is disclosed as being affixed to the pressure chamber side of the carbon plate by a thin layer of epoxy adhesive, with the conductive coating on the piezoelectric plate being photo-etched to produce an electrode pattern corresponding to the pattern of the pressure chambers in the carbon plate, and an orifice plate is disclosed as being affixed by a thin layer of epoxy adhesive to the opposite surface of the carbon plate with orifices aligned with the orifice passages in the carbon plate. It is disclosed that since the carbon plate is conductive, it can be used as an electrode on the opposite side of the piezoelectric plate, and it is disclosed that it can provide a communication path between a vacuum source and an air-permeable, ink-impermeable layer on the ink passages to remove dissolved air from the ink in the passages.

SUMMARY OF THE INVENTION

Accordingly, the present invention is directed to a device for storing and supplying an active liquid in an ink jet printhead that substantially obviates one or more of the problems due to limitations and disadvantages of the related art.

An object of the present invention is to provide a device for storing and supplying an active liquid in an ink jet printhead which is to circulate and return the active liquid to an active liquid storage tank through a single fluid path formed from the active liquid storage tank to a heating chamber, thereby making it possible to check the completion of injection of the active liquid and increasing the jetting rate of the ink.

Additional features and advantages of the invention will be set forth in the description which follows, and in part will be apparent from the description, or can be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a device for storing and supplying an active liquid in an ink jet printhead includes: an ink injector for jetting ink stored in an ink storage tank; and an active liquid storage tank mounted in close contact with at least one side of the bottom of the ink storage tank, the active liquid storage tank storing an active liquid to be supplied to the ink injector through a single fluid path separate from another path for the ink to be jetted from said ink injector. The active liquid functions as a media to be used in the formation of ink drops, and the single fluid path being formed in the ink injector for the active liquid to be circulated through the ink injector and returned to said active liquid storage tank.

It is to be understood that both the foregoing general description and the following detailed description are exemplary and explanatory and are intended to provide a further explanation of the invention as claimed.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENT

Reference will now be made in detail to the preferred embodiments of the present invention, examples of which are illustrated in the accompanying drawings.

Figure 1:
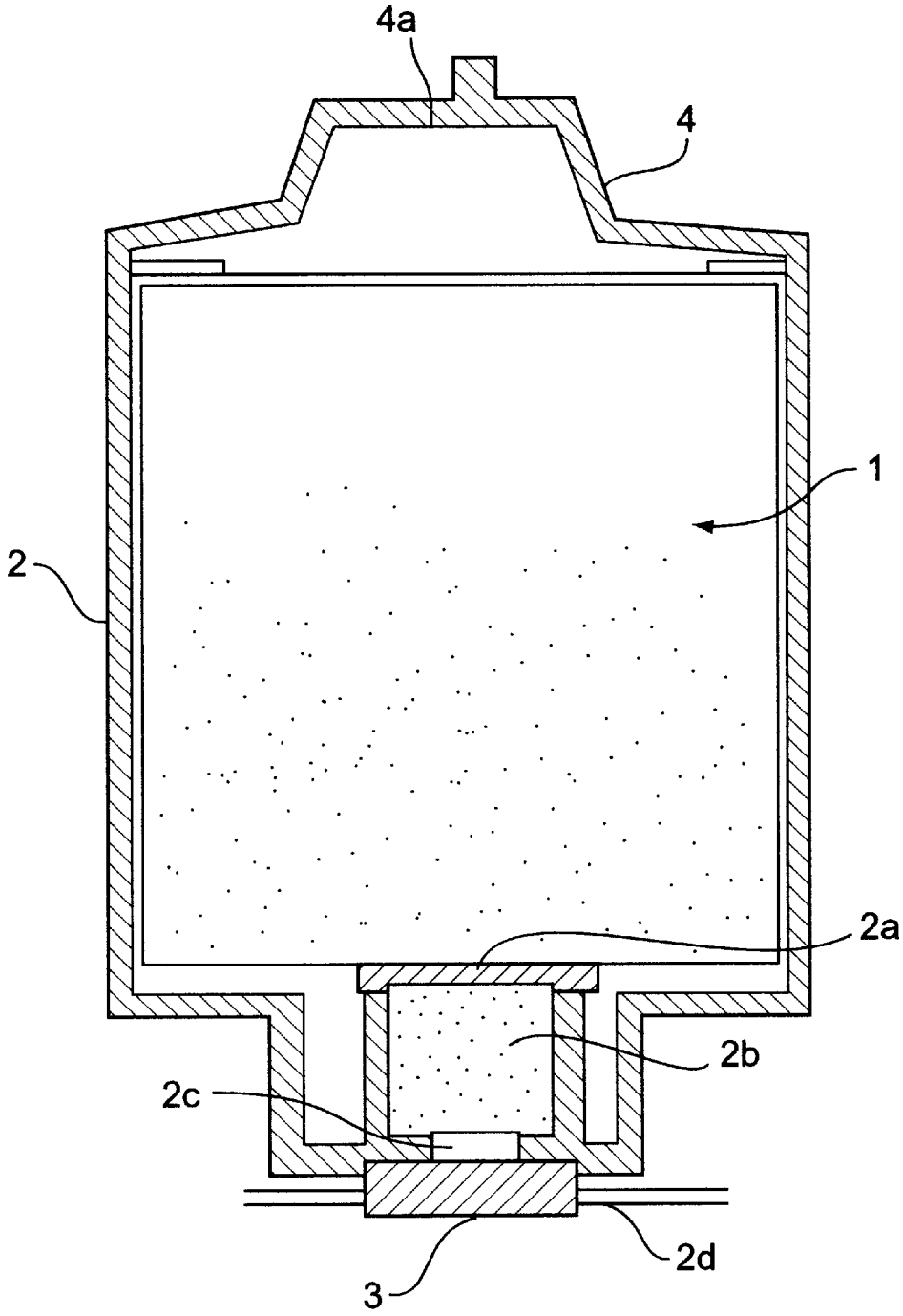
FIG. 1 is a side cross-sectional view of an exemplary ink jet printhead.

FIG. 1 shows an exemplary ink jet printhead which stores and jets ink in drops in response to the control signal applied from the control section. As shown in FIG. 1, the exemplary ink jet printhead is includes: an elastic body 1 for storing ink; a housing 2 having the ink-storing elastic body 1 built therein, and forming an ink filter 2*a* which filters the ink and is glued to the bottom surface of the ink-storing elastic body 1, an ink stand pipe 2*b* which forms a feeding path of the ink filtered through the ink filter 2*a,* and an ink via 2*c;* an ink injector 3 for injecting the ink supplied through the ink via 2*c* of the housing 2 in drops in response to an electrical signal applied to an electrical connection 2*d;* and a housing cover 4 for covering the housing 2 tightly by heat or ultrasonic fusion after the ink-storing elastic body 1 is mounted in the housing 2, and making an orifice 4*a* to maintain the atmospheric pressure constant.

Figure 2:
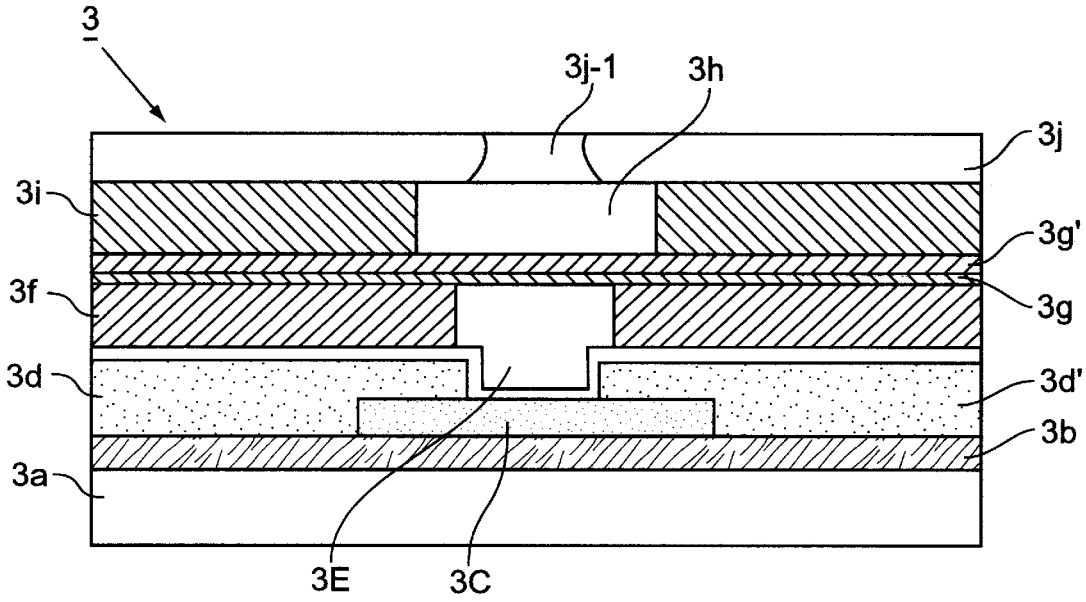
FIG. 2 is a cross-sectional view of the ink injector shown in FIG. 1.

As illustrated in FIG. 2, the ink enjector 3 of the exemplary ink jet printhead includes: a substrate 3*a* providing a support; a metal layer 3*b* deposited on the substrate 3*a;* a heater 3*c* deposited on the metal layer 3*b* in a specified pattern to convert electrical energy to heat; two electrodes 3*d* and 3*d*' deposited in contact with the heater 3*c* in order to supply electrical energy to the heater 3*c;* a heating chamber barrier 3*f* deposited on the upper surface of the two electrodes 3*d* and 3*d*' so as to form a heating chamber 3*e;* plural membranes 3*g* and 3*g*' glued to the upper surface of the heating chamber barrier 3*f* and heated by the heater 3*c* to be expanded and changed in shape; an ink chamber barrier 3*i* glued to the upper surface of the plural membranes 3*g* and 3*g*' so as to form an ink chamber 3*h;* and a nozzle plate 3*j* glued to form an orifice 3*j*-1 in accord to the ink chamber 3*h*.

The ink jet printhead of such a configuration maintains the pressure in the housing 2 at the atmospheric pressure through the orifice 4*a* disposed at a specified position in the housing cover 4. Jetting ink through the ink injector 3 while maintaining the pressure in the housing at the atmospheric pressure causes a suction, that is, a buoyant pressure generated from the jetting force.

The buoyant pressure produced in the ink enjector 3 of the inkjet printhead forces the ink in an open shell formed in the ink-storing elastic body 1 to be filtered through ink filter 2*a* and supplied to the ink enjector 3 via the ink stand pipe 2*b* and ink via 2*c*.

The ink supplied to the ink enjector 3 forms droplets and is jetted according to the electrical signal applied to the electrical connection 2*d*. That is, electrical energy is applied to the heater 3*c* through the two electrodes 3*d* and 3*d*', wherein the heater 3*c* is deposited in a specified pattern on the metal layer 3*b* overlying the substrate 3*a* which is to support the ink enjector 3.

The electrical energy applied to the heater 3*c* heats the active liquid filled in the heating chamber 3*e* to create the vapor pressure, which causes a plurality of membranes 3*g* and 3*g*' to be expanded.

In addition to the expansion of the plural membranes 3*g* and 3*g*', the vapor pressure expands the ink which is supplied to the ink chamber 3*h* defined by the ink via 2*c* and the ink chamber barrier 3*i*. As the expansion of ink interrupts the electrical energy supply to the two electrodes 3*d* and 3*d*', the expanded ink forms droplets due to the surface tension and is jetted onto the print media.

Once the ink droplets are jetted through the ink injector 3, external air is introduced through the orifice 4*a* disposed at a specified position in the housing cover 4 such that the top portion of the ink-storing elastic body 1 is filled with air in an amount as much as the jetted ink. Under pressure as much as the amount of air that fills the top portion of the ink-storing elastic body 1, the ink moves down to the bottom of the elastic body 1. Ink enjector 3 jets the ink onto the print media to produce a font or graphic image according to the electrical signal applied from the electrical connection 2*d*.

Figure 3:
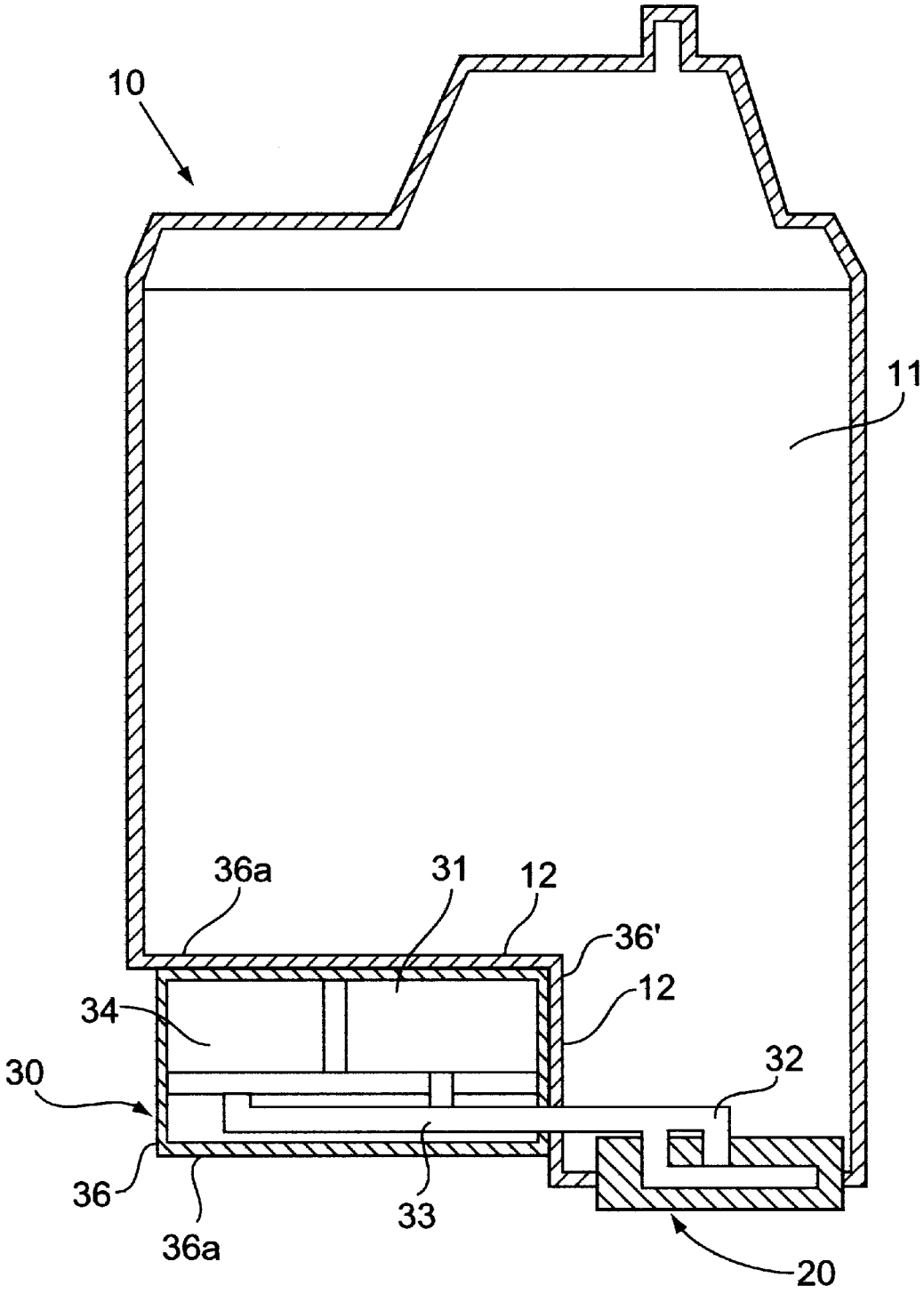
FIG. 3 is a side cross-sectional view of the ink jet printhead employing a device for storing and supplying an active liquid in accordance with the present invention.

FIG. 3 is a side cross-sectional view of the ink jet printhead employing a device for storing and supplying an active liquid according to the present invention. As shown in FIG. 3, ink jet printhead 10 of the present invention includes: an ink storage tank 11 for storing ink; an ink enjector 20 for jetting the ink supplied from the ink storage tank 11; and an active liquid storage tank 30 mounted in close contact with at least one side 12 of the bottom of the ink storage tank 11, and storing an active liquid to be supplied to the ink injector 20, wherein the active liquid is circulated and returned to the active liquid storage tank 30 through a single fluid path including and formed in the ink injector 20.

The active liquid storage tank 30 includes a rear case 36' mounted in close contact with the at least one side 12 of the bottom of the ink storage tank 11, and a front case 36 fixed to the rear case 36', such as by being glued with a sealing or melt adhesive 36*a*.

Figure 4:
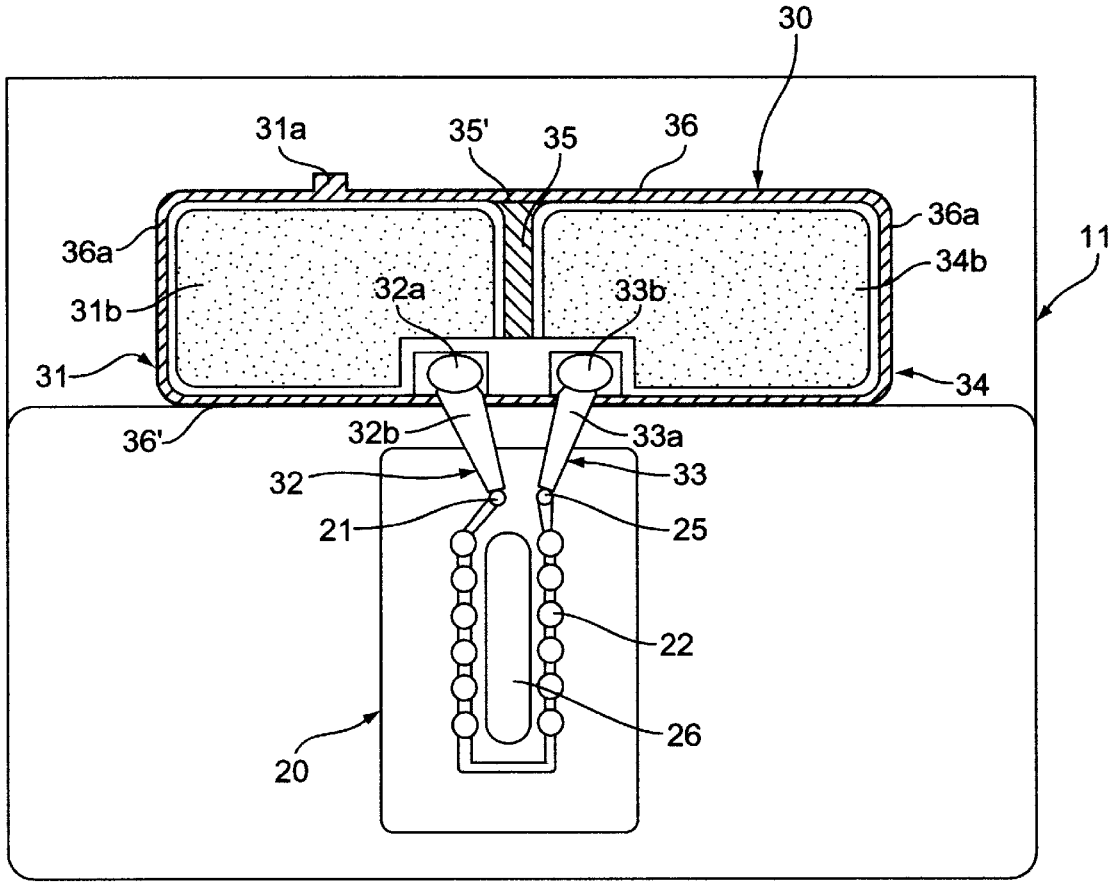
FIG. 4 is a rear view including a sectional view illustrating the configuration of the device for storing and supplying an active liquid as shown in FIG. 3.
Figure 5:
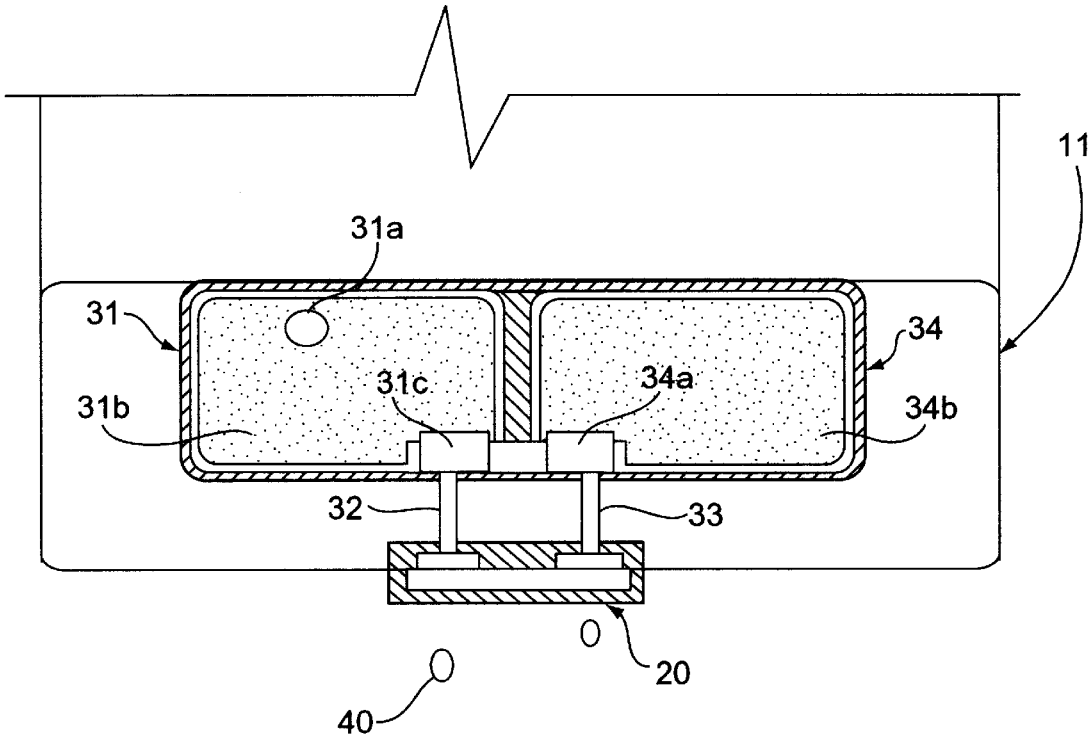
FIG. 5 is an enlarged view including a sectional view of the active liquid storing section shown in FIG. 4.
Figure 6:
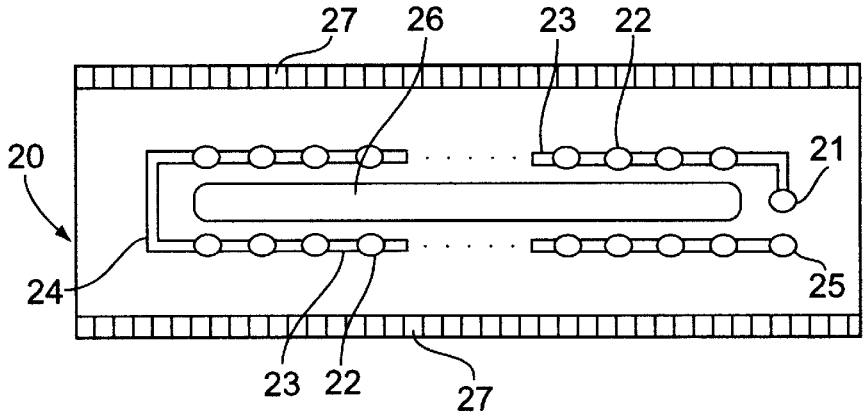
FIG. 6 is a rear view of the ink injector of the ink jet printhead shown in FIG. 4.

Referring to FIG. 4, FIG. 4 illustrates an embodiment of a device for storing and supplying an active liquid employed in the ink jet printhead of FIG. 3. The device comprises: an ink enjector 20 forming a single fluid path which includes a first common ink feeding aperture 21 supplied with an active liquid for activating ink drop or drops 40 from ink stored in ink storage tank 11 (FIG. 5), a plurality of heating chambers 22, and a first common ink circulating aperture 25; a first channel section 32 mounted to be in accord with the first common ink feeding aperture 21 of the ink injector 20; a second channel section 33 mounted to be in accord with the first common ink circulating aperture 25 of the ink injector 20; and an active liquid storage tank 30 including a first storage section or tank 31 for storing the active liquid to be fed into the ink enjector 20, and a second storage section or tank 34 for storing the active liquid supplied to the ink enjector 20, circulated and returned through the second channel section 33.

The ink enjector 20 illustrated in FIGS. 3 and 4 comprises: an ink feeding orifice 26 through which ink stored in the ink storage tank 11 is introduced; a first common ink feeding aperture 21 through which an active liquid is supplied, the ink active liquid for providing the vapor pressure in order to form droplets of the ink fed into the ink feeding orifice 26; a plurality of heating chambers 22 forming a single fluid path connecting the first common ink feeding aperture 21 so as for the active liquid to be circulated; and a first common ink circulating aperture 25 for draining out the circulating active liquid through the single fluid path thereof formed together with the plural heating chambers 22.

The first channel section 32 includes a first channel 32*b*, the first channel 32*b* having one side disposed in accord with the first common ink feeding aperture 21 of the ink enjector 20 in order to supply the active liquid therethrough, and the other side of the first channel 32*b* having a second common ink feeding aperture 32*a* for receiving the active liquid from the first storage section 31.

The second channel section 33 includes a second channel 33*a*, the second channel 33*a* having one side disposed in accord with the first common ink circulating aperture 25 of the ink injector 20 in order to receive the active liquid flowing out of the first common ink circulating aperture 25, and the other side of the second channel 33*a* having a second common ink circulating aperture 33*b* for draining out the active liquid to the second storage section 34.

The first storage section 31 of the active liquid storage tank 30 comprises: an air/active liquid injecting orifice 31*a* mounted in accord with the first storage section 31 which is in communication with the first channel section 32 in order to permit the circulation of the active liquid and maintain the internal pressure constant; and a first elastic body 31*b* for storing the active liquid supplied from the air/active liquid injecting orifice 31*a*.

The second storage section 34 of the active liquid storage tank 30 is comprised of a second storage section 34*b* mounted in accord with the second common ink circulating aperture 33*b* of the second channel section 33 to form a single fluid path through which the active liquid drained out of the second common ink circulating aperture 33*b* flows, and storing the active liquid circulated and returned thereto. The first and second storage sections 31 and 34 are separated from each other by the separating wall 35.

The operation of the device for storing and supplying the active liquid as constructed above will be described below with reference to FIGS. 3–6. Referring to FIGS. 3–6, the active liquid storage tank 30 disposed at the bottom on the at least one side 12 of ink storage tank 11 of the ink jet printhead 10 has the first and second storage sections 31 and 34 such that it is in close contact with a space defined by the front case 36 and rear case 36'.

The first and second storage sections 31 and 34 are separated from each other with respect to the ink injector 20. The ink injector 20 is disposed between the first and second storage sections 31 and 34 in order to form a single fluid path for the active liquid. The first and second storage sections 31 and 34 are separated from each other by the separating wall 35 formed in the front case 36 and rear case 36', and the pressure thereof is maintained uniform by means of threshhole 35'.

The first storage section 31 stores the active liquid which has been absorbed into the first elastic body 31*b*. The first elastic body 31*b* of the first storage section 31 is mounted such that it is pressed in coupling together the front case 36 and rear case 36'. That is, the first elastic body 31*b* is mounted in the internal space of the rear case 36' and then a cross-sectional portion of the rear case 36' is coupled or fixed, such as by being glued, to the front case 36, the adhesion being achieved such as by use of a sealing or melt adhesive technique, for example.

Upon coupling the front case 36 and rear case 36' tightly, the first elastic body 31*b* is under a specified pressure due to the force coupling the front case 36 to the rear case 36'. At this stage, the second elastic body 34*b* mounted in the space defined by the front case 36 and rear case 36' is fixed simultaneously with the first elastic body 31*b*.

The first elastic body 31*b* of the first storage section 31, under the initial pressure arising from the front case 36, supplies the active liquid stored therein to the plural heating chambers 22 of the ink injector 20. However, the active liquid is first filtered through a first filter 31*c*. The first filter 31*c* is formed integrally with the first storage section 31 in order to remove foreign materials contained in the active liquid supplied from the first elastic body 31*b*. Passing through the first filter 31*b*, the active liquid flows into the first channel section 32. That is, the active liquid passes through the second common ink feeding aperture 32*a* formed in close contact with the first filter 31*b*, flowing into the first channel 32*b* that forms a single fluid path.

The active liquid flowing through the first channel 32*b* enters a plurality of heating chambers 22 via the first common ink feeding aperture 21 formed in the ink injector 20, and flows through the heating chambers through heating chamber channels 23 disposed between the chambers 22.

After a specified number of heating chambers 22 are filled with the active liquid, the active liquid fills the rest of the heating chambers 22 through circulating channels 24. That is, the active liquid supplied via the first common ink feeding aperture 21 flows from the first heating chamber 22 to another heating chamber 22 through the heating chamber channel 23 between the heating chambers 22.

Once a plurality of heating chambers 22 arranged to form a single fluid path are filled with the active liquid, the active liquid flows out of the first common ink circulating aperture 25 and enters the second channel section 33. The second channel section 33 has a second channel 33*a* constructed in accord with the first common ink circulating aperture 25 for the active liquid to flow therethrough. The active liquid flows through a second common ink circulating aperture 33*b* disposed in accord with the second channel 33*a* and is filtered by a second filter 34*a* mounted in close contact with the second common ink circulating aperture 33*b*. It is then stored in the second elastic body 34*b* of the second storage section 34.

Once injected into the air/active liquid injecting orifice 31*a* disposed in the front case 36 of the active liquid storage tank 30, the active liquid flows through the single fluid path including the first storage section 31, the first channel 32*b*, the ink injector 20, the second channel 33*a* and the second storage section 34. The active liquid which has passed through the single fluid path fills the plurality of heating chambers 22 formed in the ink injector 20, circulating and returning to the second storage section 34. Further, the air/active liquid injecting orifice 31*a* maintains the pressure constant in order to keep the circulation of the active liquid into the heating chambers 22 when vapor pressure occurs in the plural heating chambers 22. Accordingly, the completion of injection of the active liquid into the plural heating chambers 22 formed in the ink injector 20 can be checked at any time that the active liquid fills the second storage section 34 in the initial injection of the active liquid.

When the plurality of heating chambers 22 of the ink injector 20 are filled with the active liquid in the active liquid storage tank 30, the ink stored in the ink storage tank 11 is supplied, such as by an ink stand pipe and ink via communicating with the ink storage tank 11 similar to the illustration of FIG. 1, for example, to the ink injector 20 via the ink feeding orifice 26.

Figure 7:
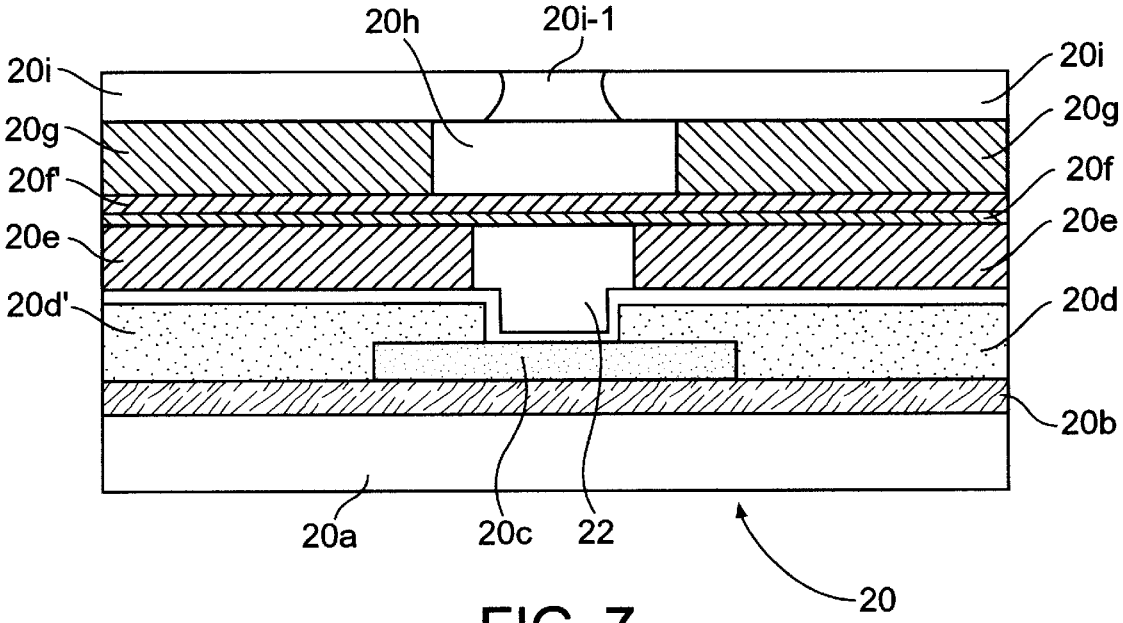
FIG. 7 is an enlarged cross-sectional view illustrating the ink injector shown in FIG. 4.

The structure of the ink injector 20 supplied with both ink and active liquid will be described below with reference to FIG. 7. As shown in FIG. 7, the ink enjector 20 comprises: a substrate 20*a* providing a support; a metal layer 20*b* deposited on the substrate 20*a;* a heater 20*c* deposited on the metal layer 20*b;* two electrodes 20*d* and 20*d*' for supplying electrical energy to the heater 20*c;* heating chamber barriers 20*e* deposited on the upper surface of the two electrodes 20*d* and 20*d*'; heating chambers 22 defined by the heating chamber barriers 20*e* having a cavity in order to be supplied with the active liquid from the first common ink feeding aperture 21 (FIG. 4); a plurality of membranes 20*f* and 20*f*' fixed, such as by being glued, to the upper surface of the heating chambers 22 and heated by the heater 20*c* to be expanded in volume due to the vapor pressure of the active liquid; an ink chamber barrier 20*g* fixed, such as by being glued, to the upper surface of the plural membranes 20*f* and 20*f*' so as to form an ink chamber 20*h;* and a nozzle plate 20*i* fixed, such as by being glued, to have an orifice 20*i*-1 in accord to the ink chamber 20*h* defined by the ink chamber barrier 20*g*.

The operation of the ink injector 20 will be described as follows in connection with FIGS. 8 to 13. Generally, ink jet printhead 10 processes the print data externally applied to the control section (not shown) thereof, generating a print control signal which is sent to head drive circuitry (not shown). The ink enjector 20 of the inkjet printhead 10 is driven in response to the print control signal.

Under the control of the head drive circuitry, the ink enjector 20 applies electrical energy which is a common voltage to the one of two electrode layers 20*d* and 20*d*'. At this stage, the other electrode layer is opened or circuit-shorted under the control of the head drive circuitry. That is, the head drive circuitry is to control the orifice 20*i*-1 formed in the nozzle plate 20*i* of the ink enjector 20 in order to create an ink image according to the print data externally applied.

The ink injector 20 is supplied with the ink stored in the ink storage tank 11 (FIG. 3) via the ink feeding orifice 26. Before the ink is supplied through the ink feeding orifice 26, the ink enjector 20 is supplied with the active liquid from the first storage section 31 (FIG. 4) of the active liquid storage tank 30 via the first channel 32*b* (FIG. 4). The active liquid supplied through the first channel 32*b* flows into the plurality of heating chambers 22 of the ink injector 20.

As the plural heating chambers 22 formed in the ink enjector 20 are all filled with the active liquid, electrical energy is applied to one of the two electrode layers 20*d* and 20*d*' under the control of the head drive circuitry, with the electrode layer supplying the electrical energy to the heater 20*c* which is energized to generate heat.

Figure 8:
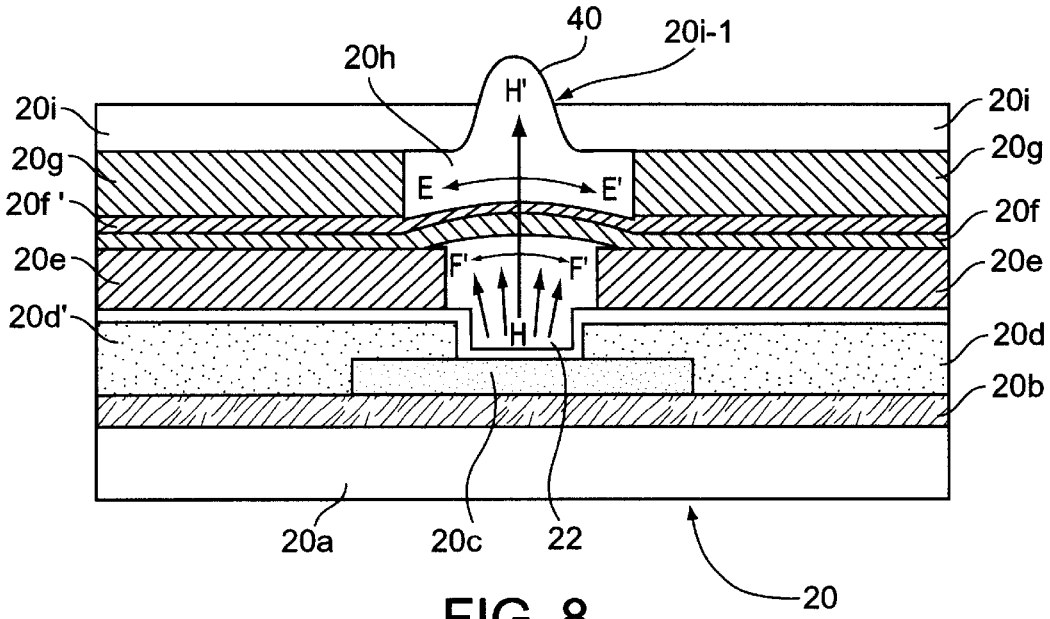
FIG. 8 illustrates the state of the active liquid in the ink injector in FIG. 7 being initially heated.

That is, the heater 20*c,* which can be one or more resistors, converts the electrical energy to heat, heating the active liquid in the heating chambers 22. As illustrated in FIG. 8, the active liquid in the heating chambers 22 is heated to generate the vapor pressure rising in the vertical direction H–H'. This rising hot vapor pressure causes the plurality of membranes 20*f* and 20*f*' to be expanded in the vertical direction H–H', forming a curve towards the ink chamber 20*h*.

The expansion of the plural membranes 20*f* and 20*f*' with increasing the vapor pressure of the active liquid imposes a force on the ink supplied from the feeding orifice 26 (FIG. 4) to the ink chamber 20*h,* so that the ink is expelled out of the orifice 20*i*-1 formed in the nozzle plate 20*i*.

Figure 9:
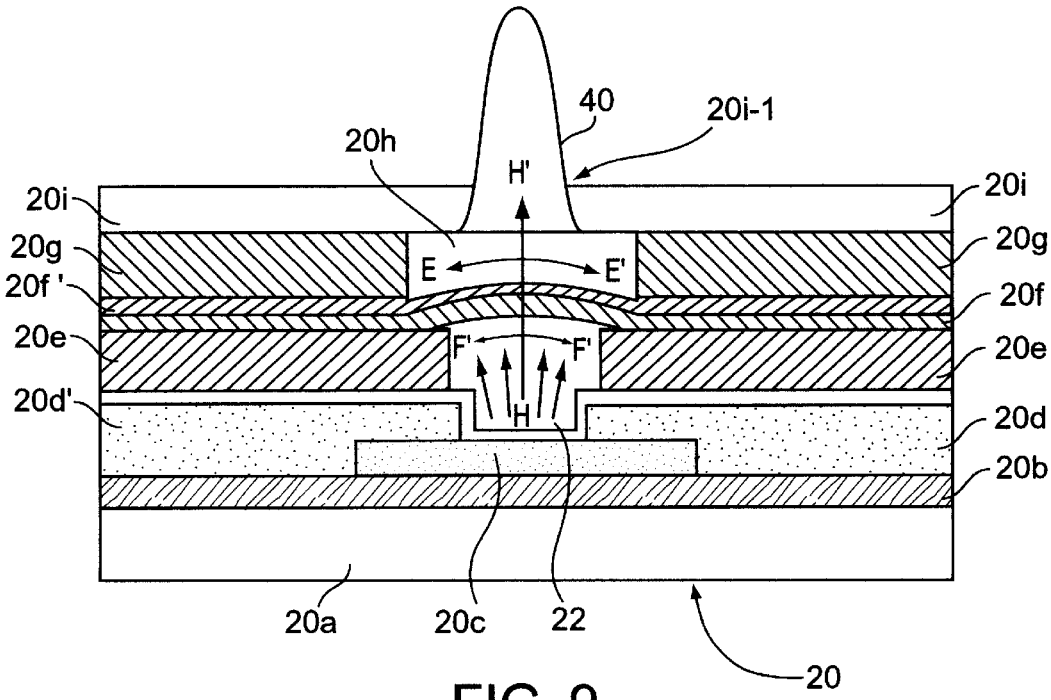
FIG. 9 illustrates the state of the active liquid in the ink injector in FIG. 7 being heated and expanded.

With an increase in the vapor pressure of the active liquid in the heating chambers 22, as shown in FIG. 9, the plural membranes 20*f* and 20*f* are expanded increasingly to force the ink in the ink chamber 20*h* strongly to be expelled out of the orifice 20*i*-1.

Figure 10:
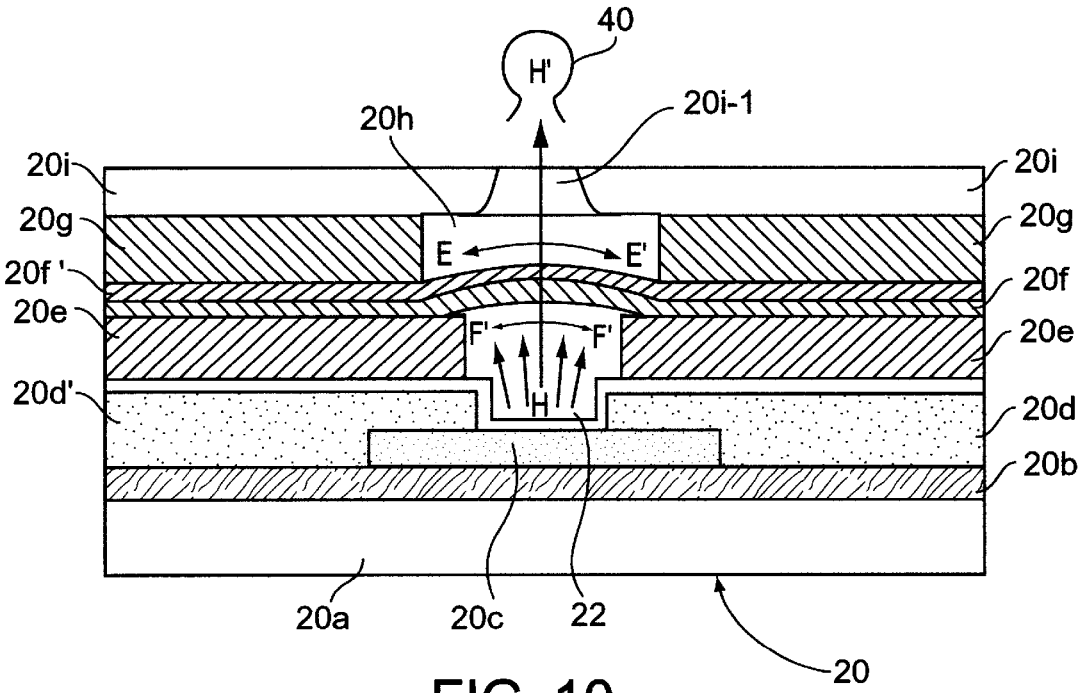
FIG. 10 illustrates the state of the active liquid in the ink injector in FIG. 7 before injection.
Figure 11:
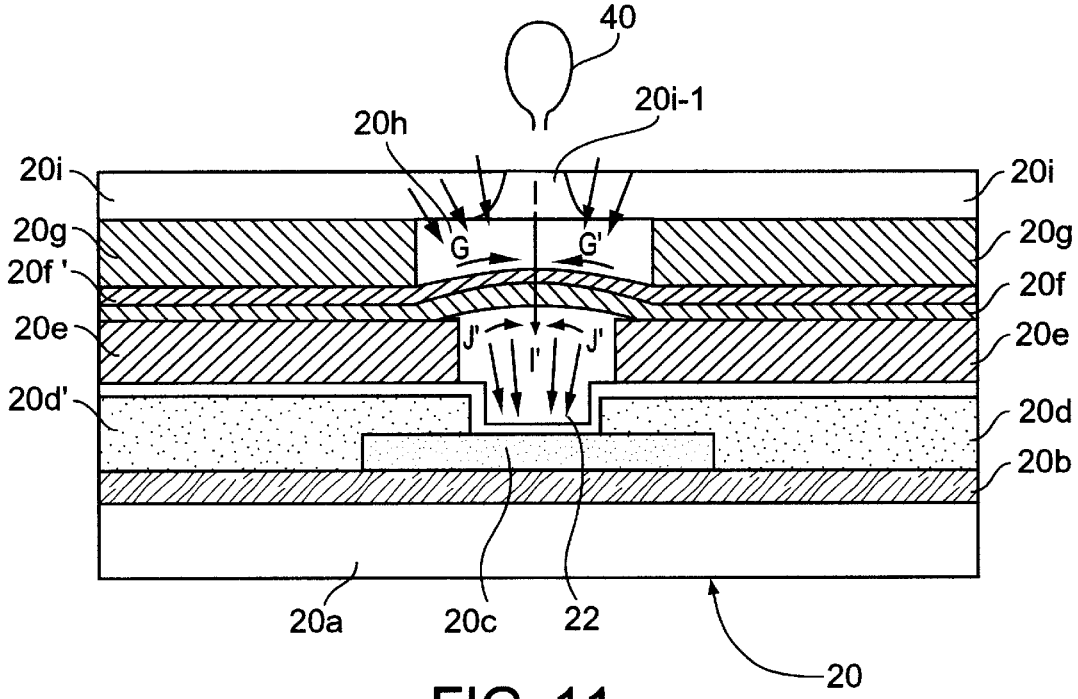
FIG. 11 illustrates the state of the active liquid in the ink injector in FIG. 7 being jetted and condensed.

As shown in FIG. 10, when the plural membranes 20*f* and 20*f*' are expanded to the maximum, the ink in the ink chamber 20*h* is expelled out of the orifice 20*i*-1. If the one of the two electrode layers 20*d* and 20*d*' receiving electrical energy is opened by the head drive circuitry, the electrical energy supply to the heater 20*c* is interrupted. With interruption of the electrical energy, the plural membranes 20*f* and 20*f*' are shrunk in the G–G' and J–J' directions as illustrated in FIG. 11 so that the force generated from the ink chamber 20*h* and the heating chambers 22 moves in the I–I' direction. This causes ink drop 40 due to the surface tension of the ink.

As the operating temperature of the heater 20*c* decreases, the active liquid in the heated heating chambers 22 is condensed and replaced with the active liquid supplied from an unheated heating chamber 22 via the channel 23 (FIG. 6) between the heating chambers 22.

Figure 12:
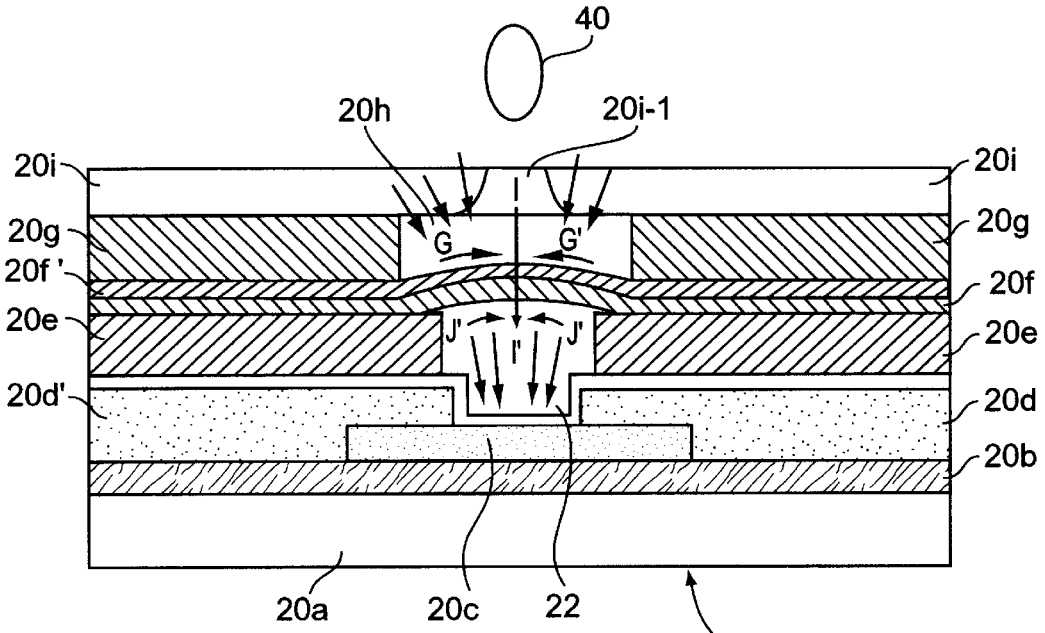
FIG. 12 illustrates the state of the active liquid in FIG. 7 being condensed and cooled.
Figure 13:
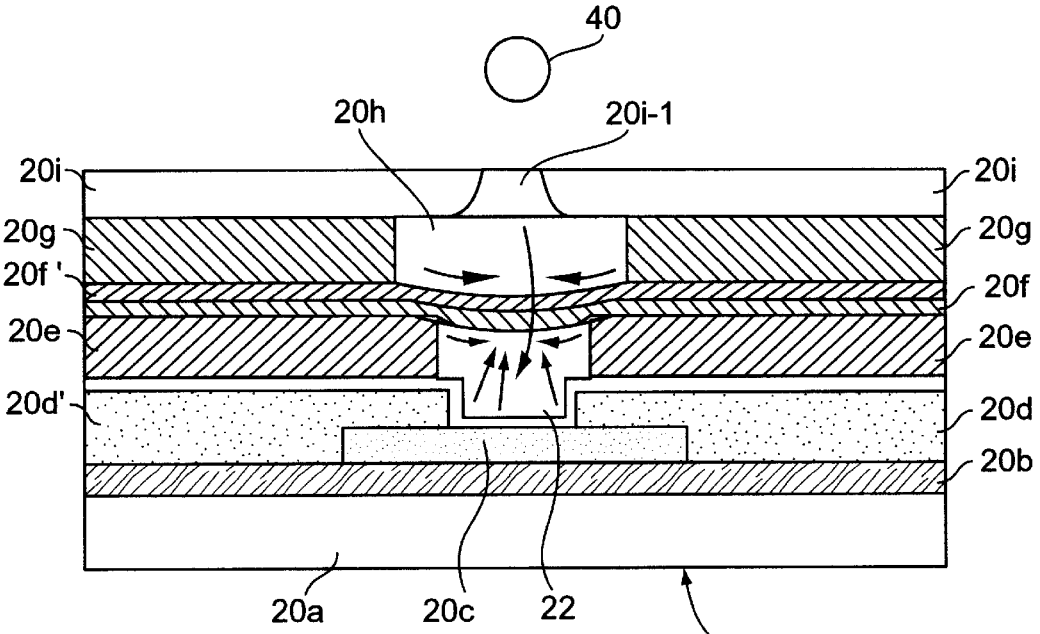
FIG. 13 illustrates the buckling phenomenon of the active liquid in FIG. 7.

As the unheated active liquid flows into the heated heating chambers 22, as shown in FIG. 12 and FIG. 13, the plural membranes 20*f* and 20*f'* are shrunk in the I–I' direction of the heating chambers 22 rapidly, jetting the ink in drops 40 onto the print media to create an image according to the print data externally applied. As described above, the active ink is cooled rapidly with the active liquid in the unheated heating chambers 22, which raises the jetting rate of the ink drops 40.

In the present invention as described above, the inkjet printhead is provided with a fluid path formed therein for supplying the active liquid between the heating chambers in the ink injector, cooling the heating chambers rapidly with high speed of printing. Also, ink enjector can be readily mounted in the ink jet printhead before the injection of the active liquid thereinto, making it possible to check the completion of injection of the active liquid through the feeding and circulating apertures.

It will be apparent to those skilled in the art that various modifications and variations can be made in the device for storing and supplying an active liquid in an inkjet printhead according to the present invention without departing from the spirit or scope of the invention. Thus, it is intended that the present invention cover the modifications and variations of this invention within the scope of the appended claims and their equivalents.

What is claimed is:

1. A device for storing and supplying an active liquid in an ink jet printhead, comprising:

an ink injector for jetting ink stored in an ink storage tank, the ink injector having a single fluid path therein for the active liquid, the single fluid path being separate from another path for the ink to be jetted from the ink injector; and an active liquid storage tank mounted in close contact with at least one side of the bottom of the ink storage tank, said active liquid storage tank for storing said active liquid to be supplied to the ink injector, said active liquid functioning as a media for use in formation of ink drops from the ink, and the single fluid path for circulating the active liquid from the active liquid storage tank through the ink injector for return of the active liquid to the active liquid storage tank.

2. The device according to claim 1, wherein the active liquid storage tank is mounted in a space formed by a rear case and a front case, the rear case being in close contact with the at least one side of the bottom of the ink storage tank, and the front case being fixed to the rear case.

3. The device according to claim 1, wherein the ink injector comprises:

an ink feeding orifice adapted to be supplied with the ink stored in the ink storage tank;

a first common ink feeding aperture adapted to be supplied with the active liquid for providing vapor pressure in order to cause drops of the ink supplied to the ink feeding orifice;

a plurality of heating chambers associated with the first common ink feeding aperture to form a portion of the single fluid path for receiving and circulating the active liquid; and a first common ink circulating aperture associated with the plurality of heating chambers to form a portion of the single fluid path for flowing out the active liquid circulated through the ink injector for return to the active liquid storage tank.

4. The device according to claim 3, wherein the active liquid storage tank has a first storage section and a second storage section, the first storage section for storing the active liquid to be supplied to the ink injector through a first channel section, the second storage section for storing the active liquid supplied to the ink injector after the active liquid has been circulated in the ink injector for return of the active liquid to the active liquid storage tank through a second channel section.

5. The device according to claim 4, wherein the first channel section comprises a first channel having one side disposed in accord with the first common ink feeding aperture of the ink injector in order to supply the active liquid therethrough, and the first channel having another side disposed in accord with a second common ink feeding aperture for receiving the active liquid from the first storage section, and wherein the second channel section comprises a second channel having one side disposed in accord with the first common ink circulating aperture of the ink injector in order to receive the active liquid flowing out of the first common ink circulating aperture, and the second channel having another side disposed in accord with a second common ink circulating aperture for draining out the active liquid to the second storage section.

6. The device according to claim 5, wherein the first storage section of the active liquid storage tank comprises:

an orifice for injecting at least one of air and active liquid formed on one side of the first storage section in accord with the first channel section in order to maintain the circulation of the active liquid and a constant internal pressure; and a first elastic body for storing the active liquid for circulation to the ink injector, and the second storage section of the active liquid storage tank comprises a second elastic body disposed to form a path for the active liquid flowing out of the second common ink circulating aperture disposed in accord with the second channel section and for storing the active liquid circulated through and returned from the ink injector.

7. The device according to claim 6, wherein the first storage section and the second storage section are separated from each other by a separating wall.

8. The device according to claim 6, wherein the first storage section filters the active liquid to be supplied to the plurality of heating chambers of the ink injector through a filter.

9. The device according to claim 4, wherein the first storage section of the active liquid storage tank comprises:

an orifice for injecting at least one of air and active liquid formed on one side of the first storage section in accord with the first channel section in order to maintain the circulation of the active liquid and a constant internal pressure; and a first elastic body for storing the active liquid for circulation to the ink injector, and the second storage section of the active liquid storage tank comprises a second elastic body disposed to form a path for the active liquid flowing out of a second common ink circulating aperture disposed in accord with the second channel section and for storing the active liquid circulated through and returned from the ink injector.

10. A device for storing and supplying an active liquid in an inkjet printhead, comprising:

an ink injector for jetting ink stored in an ink storage tank, the ink injector having a single fluid path formed in the ink injector for circulating the active liquid, the active liquid functioning as a media for use in formation of ink drops from the ink, the single fluid path being separate from another path for the ink to be jetted from the ink injector, the single fluid path including a first common ink feeding aperture for receiving the active liquid, a plurality of heating chambers, and a first common ink circulating aperture;

a first channel section disposed in accord with the first common ink feeding aperture of the ink injector;

a second channel section disposed in accord with the first common ink circulating aperture of the ink injector; and an active liquid storage tank having a first storage section and a second storage section, the first storage section for storing the active liquid to be supplied to the ink injector through the first channel section, the second storage section for storing the active liquid supplied to the ink injector after the active liquid has been circulated in the ink injector for return of the active liquid to the active liquid storage tank through the second channel section.

11. The device according to claim 10, wherein the ink injector further comprises an ink feeding orifice supplied with the ink stored in the ink storage tank, and wherein the first common ink feeding aperture is adapted to be supplied with the active liquid for providing vapor pressure in order to cause drops of the ink supplied to the ink feeding orifice, the plurality of heating chambers being associated with the first common ink feeding aperture to form a portion of the single fluid path for receiving and circulating the active liquid, and the first common ink circulating aperture being associated with the plurality of heating chambers to form a portion of the single fluid path for flowing out of the active liquid circulated through the ink injector for return of the active liquid to the active liquid storage tank.

12. The device according to claim 10, wherein the first channel section comprises a first channel having one side disposed in accord with the first common ink feeding aperture of the ink injector in order to supply the active liquid therethrough, and the first channel having another side disposed in accord with a second common ink feeding aperture for receiving the active liquid from the first storage section.

13. The device according to claim 10, wherein the second channel section comprises a second channel having one side disposed in accord with the first common ink circulating aperture of the ink injector in order to receive the active liquid flowing out of the first common ink circulating aperture, and the second channel having another side disposed in accord with a second common ink circulating aperture for draining out the active liquid to the second storage section.

14. The device according to claim 10, wherein the first storage section of the active liquid storage tank comprises:

an orifice for injecting at least one of air and active liquid formed on one side of the first storage section in accord with the first channel section in order to maintain the circulation of the active liquid and a constant internal pressure; and a first elastic body for storing the active liquid for circulation to the ink injector.

15. The device according to claim 10, wherein the second storage section of the active liquid storage tank comprises a second elastic body disposed to form a path for the active liquid flowing out of a second common ink circulating aperture disposed in accord with the second channel section and for storing the active liquid circulated through and returned from the ink injector.

16. The device according to claim 10, wherein the first storage section and the second storage section are separated from each other by a separating wall.

17. The device according to claim 10, wherein the first storage section filters the active liquid to be supplied to the plurality of heating chambers of the ink injector through a filter.

18. The device according to claim 10, wherein the first channel section comprises a first channel having one side disposed in accord with the first common ink feeding aperture of the ink injector in order to supply the active liquid therethrough, and the first channel having another side disposed in accord with a second common ink feeding aperture for receiving the active liquid from the first storage section, and wherein the second channel section comprises a second channel having one side disposed in accord with the first common ink circulating aperture of the ink injector in order to receive the active liquid flowing out of the first common ink circulating aperture, and the second channel having another side disposed in accord with a second common ink circulating aperture for draining out the active liquid to the second storage section.

19. The device according to claim 18, wherein the first storage section of the active liquid storage tank comprises:

an orifice for injecting at least one of air and active liquid formed on one side of the first storage section in accord with the first channel section in order to maintain the circulation of the active liquid and a constant internal pressure; and a first elastic body for storing the active liquid for circulation to the ink injector, and the second storage section of the active liquid storage tank comprises a second elastic body disposed to form a path for the active liquid flowing out of the second common ink circulating aperture disposed in accord with the second channel section and for storing the active liquid circulated through and returned from the ink injector.

20. The device according to claim 19, wherein the first storage section and the second storage section are separated from each other by a separating wall, and the first storage section filters the active liquid to be supplied to the plurality of heating chambers of the ink injector through a filter.

* * * * *